US006429589B2

(12) United States Patent
Schult

(10) Patent No.: US 6,429,589 B2
(45) **Date of Patent: *Aug. 6, 2002**

(54) OIL-COOLED MULTI-STAGED DEPRESSED COLLECTOR HAVING CHANNELS AND DUAL SLEEVES

(75) Inventor: Holger Schult, Montoursville, PA (US)

(73) Assignee: Northrop Grumman Corporation, Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,171

(22) Filed: Apr. 16, 1999

(51) Int. Cl.[7] ..... H01J 23/033; H01J 25/02

(52) U.S. Cl. ..... 315/5.37; 315/5.38; 315/5.39; 313/35; 313/36

(58) Field of Search ..... 315/5.37, 5.38, 315/5.39; 313/35, 36

(56) References Cited

U.S. PATENT DOCUMENTS

| | | | | | |
|---|---|---|---|---|---|
| 3,305,742 A | * | 2/1967 | McCune | 313/36 X |
| 3,359,451 A | * | 12/1967 | Zitelli et al. | 315/5.38 |
| 3,780,336 A | | 12/1973 | Giebeler | 315/5.38 |
| 3,876,901 A | * | 4/1975 | James | 313/36 X |
| 3,886,384 A | | 5/1975 | Tuinila | 313/39 |
| 4,455,504 A | * | 6/1984 | Iversen | 313/35 X |
| 4,684,844 A | | 8/1987 | Iversen | 313/30 |
| 5,493,178 A | * | 2/1996 | Byram et al. | 315/5.38 |
| 5,650,751 A | | 7/1997 | Symons | 330/45 |

* cited by examiner

*Primary Examiner*—Benny T. Lee
(74) *Attorney, Agent, or Firm*—O'Melveny & Myers LLP

(57) ABSTRACT

An oil-cooling system is provided for a multi-staged depressed collector of a linear beam device, such as an inductive output tube or klystron. The multi-staged depressed collector comprises a plurality of electrode stages adapted to have respective electric potentials applied thereto. The electrode stages are separated from one another by respective electrical insulators. The electrode stages are provided with a plurality of channels that extend axially along the outer surfaces of the electrodes. An inner sleeve is disposed in contact with the outer surface of the electrode stages and substantially encloses the plurality of channels. An outer sleeve encloses the inner sleeve with a space defined therebetween. The inner sleeve further includes an opening at an end thereof providing an oil communication path between the space between the inner and outer sleeves, and the plurality of axially extending channels. An oil source is coupled to one of the inner sleeve and the outer sleeve in order to provide a flow of oil therethrough. In an embodiment of the invention, the outer sleeve is comprised of steel, and the inner sleeve is comprised of TEFLON. The oil-cooling system provides cooling to the entire surface of the collector, including the electrode stages and the electrical insulators. The oil resists voltage breakdown, and permits a cooling structure that takes up less space than air or water-cooling systems.

30 Claims, 3 Drawing Sheets

FIG. 3
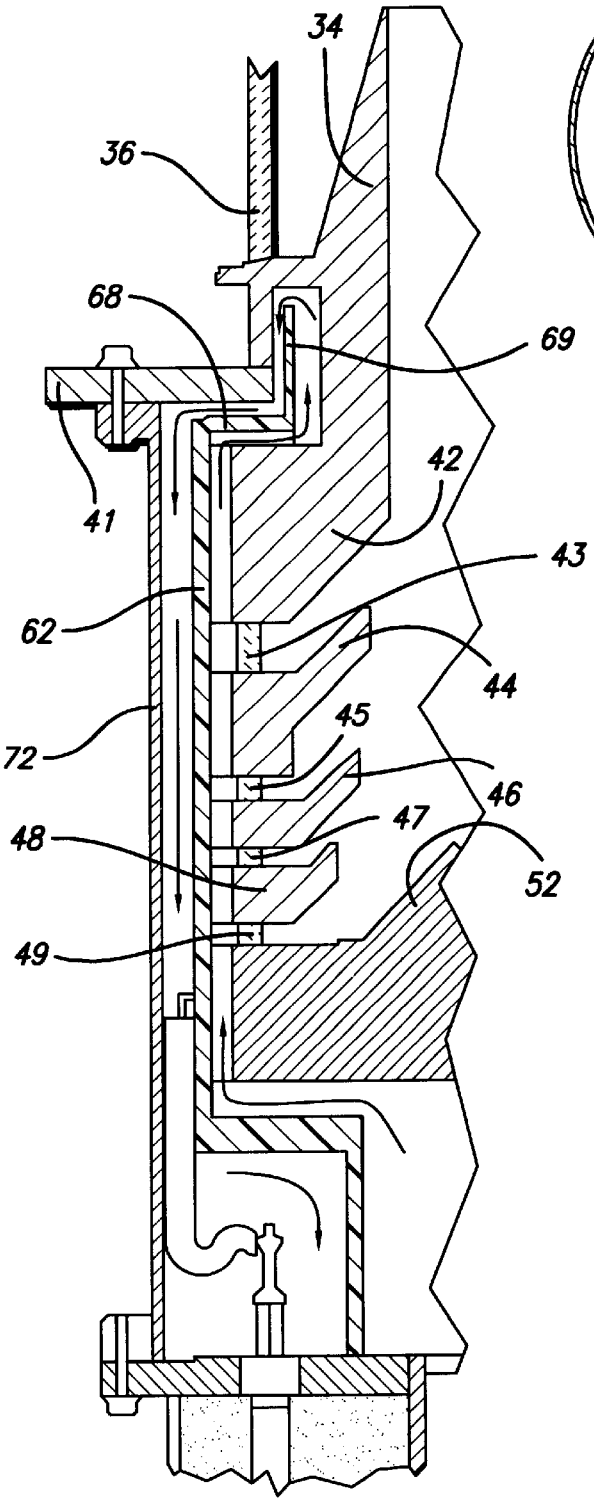
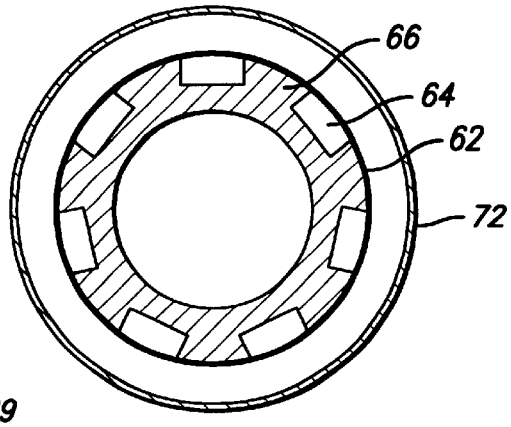
FIG. 2

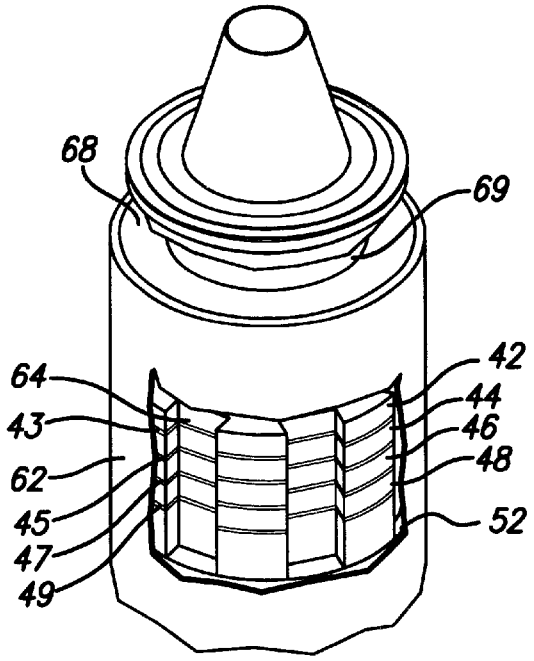
FIG. 4
FIG. 5
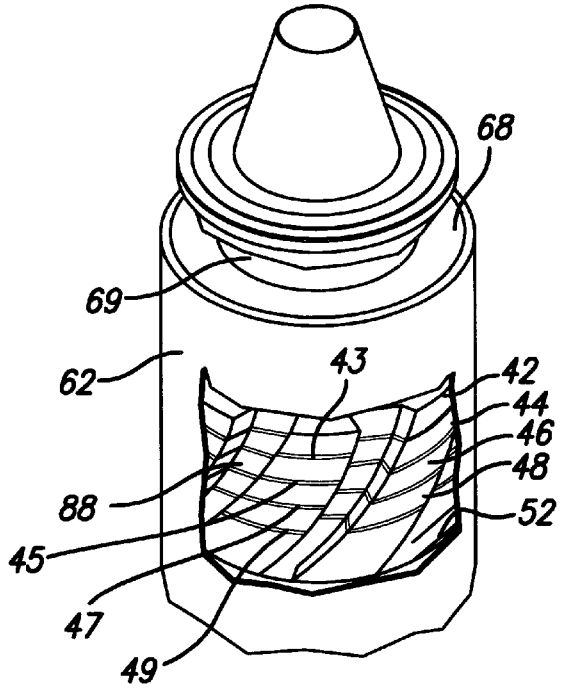

OIL-COOLED MULTI-STAGED DEPRESSED COLLECTOR HAVING CHANNELS AND DUAL SLEEVES

BACKGROUND OF THE INVENTION

1. Field of the Invention

The present invention relates to electron beam devices that utilize multi-staged depressed collectors for efficient collection of spent electrons. More particularly, the invention relates to an oil cooling system for a multi-staged depressed collector that provides good heat dissipation and high voltage standoff between adjacent collector stages.

2. Description of Related Art

It is known in the art to utilize a linear beam device, such as a klystron or travelling wave tube (TWT), for amplification of microwave signals in microwave systems. Such devices generally include an electron emissive cathode and an anode spaced therefrom. The anode includes a central aperture, and by applying a high voltage potential between the cathode and anode, electrons may be drawn from the cathode surface and directed into a high power beam that passes through the anode aperture. One class of linear beam device, referred to as an inductive output amplifier, or inductive output tube (IOT), further includes a grid disposed in the inter-electrode region defined between the cathode and anode. The electron beam may thus be density modulated by applying an RF signal to the grid relative to the cathode. The density modulated beam is accelerated by the anode, and propagates across a gap provided downstream within the inductive output amplifier. RF fields are thereby induced into a cavity coupled to the gap. The RF fields may then be extracted from the cavity in the form of a high power, modulated RF signal.

At the end of its travel through the linear beam device, the electron beam is deposited into a collector or beam dump that effectively captures the remaining energy of the spent electron beam. The electrons that exit the drift tube of the linear beam device are captured by the collector and returned to the cathode voltage source. Much of the remaining energy in the electrons is released in the form of heat when the particles strike a stationary element, such as the walls of the collector. This heat loss constitutes an inefficiency of the linear beam device, and as a result, various methods of improving this efficiency have been proposed.

One such method is to operate the collector at a "depressed" potential relative to the body of the linear beam device. In a typical linear beam device, the body of the linear beam device is at ground potential and the cathode potential is negative with respect to the body. The collector voltage is "depressed" by applying a potential that is between the cathode potential and ground. By operating the collector at a depressed state, the negative electric field within the collector slows the moving electrons so that the electrons can be collected at reduced velocities. This method increases the electrical efficiency of the RF device as well as reducing undesirable heat generation within the collector.

It is also common for the depressed collector to be provided with a plurality of electrodes arranged in sequential stages, a structure referred to as a multi-staged depressed collector. Electrons exiting the drift tube of the linear beam device actually have varying velocities, and as a result, the electrons have varying energy levels. To accommodate the differing electron energy levels, the respective electrode stages have incrementally increasing negative potentials applied thereto with respect to the linear device body, such that an electrode having the highest negative potential is disposed the farthest distance from the interaction structure. This way, electrons having the highest relative energy level will travel the farthest distance into the collector before being collected on a final one of the depressed electrodes. Conversely, electrons having the lowest relative energy level will be collected on a first one of the depressed electrodes. By providing a plurality of electrodes of different potential levels, each electron can be collected on a corresponding electrode that most closely approximates the electron's particular energy level. Thus, efficient collection of the electrons can be achieved. The significant efficiency improvement achieved by using a multi-staged depressed collector with an inductive output tube is described in U.S. Pat. No. 5,650,751, which is specifically incorporated by reference herein.

There are two significant drawbacks of multi-staged depressed collectors that must be controlled in order to have satisfactory operation. First, multi-staged depressed collectors generate a great deal of heat due to the electrons that impact the collector electrodes, and this heat must be dissipated to maintain an efficient level of operation and to prevent damage to the collector structure. Second, the adjacent electrode stages must be insulated from one another to prevent arcing due to the high voltages applied to the electrode stages. The known methods for controlling these problems often results in increasing the size and weight of the collector, so that it often becomes larger and heavier than the rest of the linear beam device.

More particularly, multi-staged depressed collectors are generally cooled using water or air as a cooling medium. To enable heat dissipation, a cooling surface is provided on an external portion of the collector that is in contact with the cooling medium. The cooling surface may be relatively small if water is used as a cooling medium, but needs to be relatively large if air is used. Since water contains positive and negative ions, high voltage electric fields tend to induce an ion current within the water. Therefore, in a water-cooled multi-staged depressed collector, the high voltages between the collector stages make it necessary to use very clean, deionized water in the water-cooling system and substantial lengths of insulating hoses to conduct the a cooling water between the individual electrode stages and between the electrode stages and ground in order to keep the ion current below a certain limit. The hoses further include seals that are susceptible to water leakage. Moreover, the water must be filtered and its resistance periodically checked; otherwise, the cooling surfaces may experience severe damage due to corrosion. An additional problem with water-cooled systems is that the hoses take up a lot of space, which defeats the advantage of having a relatively small cooling surface. Yet another problem with water-cooled systems is that the hoses cause a pressure drop in the cooling system that results in a reduction of the flow rate through the system. Lastly, unless glycol is mixed with the water, a water-cooled system will freeze at temperatures below 0° C., which is unacceptable for certain applications.

While corrosion is not an issue with air-cooled systems, such systems have other disadvantages. Particularly, air-cooled multi-staged depressed collectors need large cooling fins because of the relatively poor thermal conductivity and specific heat of air. As a result, the dissipated power of an air-cooled multi-staged depressed collector is limited to about 40 KW because it is impractical to provide a sufficiently large cooling surface to keep the temperature within an acceptable range at higher power levels. Also, an air-cooled system requires large diameter ducts and therefore a lot of space. Dust must be filtered from the air-cooled system, and the filters result in pressure drops that reduce the volume of air flow. Since the cooling surface of the collector is larger with an air-cooled system than with a water-cooled system, the metallic parts of the collector experience a greater amount of thermal expansion and oxidation of the exposed metal surfaces. Each of these factors increases the stress on the collector, which degrades the useful life of the electron beam device. A final disadvantage of air-cooling systems is that they tend to be noisy, which makes the work environment undesirable.

Generally, multi-staged depressed collectors include insulating ceramic elements provided between the adjacent electrode stages to prevent arcing in air at maximum voltage. The space between the electrode stages must be large enough to hold off a high voltage within an extreme operating environment, such as at 8,000 feet above sea level, or in high humidity, or while exposed to a certain amount of dust. The hoses used in water-cooled systems that extend between stages further exacerbate the difficulty of controlling arcing by deforming the electric fields.

Accordingly, it would be very desirable to provide a cooling system for a multi-staged depressed collector that overcomes these significant drawbacks with conventional air and water-cooled systems. Such a cooling system would ideally achieve good heat dissipation and high voltage standoff between adjacent collector stages, without increasing the overall size of the collector.

SUMMARY OF THE INVENTION

In accordance with the teachings of the present invention an oil-cooling system is provided for a multi-staged depressed collector of a linear beam device, such as an inductive output tube or klystron. As known in the art, a multi-staged depressed collector comprises a plurality of electrode stages adapted to have respective electric potentials applied thereto. The electrode stages being separated from one another by respective electrical insulators. The oil-cooling system of the present invention provides cooling to the entire surface of the collector, including the electrode stages and the electrical insulators. Oil resists voltage breakdown, and permits a cooling structure that takes up less space than air or water-cooling systems.

More particularly, the electrode stages are provided with a plurality of channels that extend along the outer surfaces of the electrodes. In an embodiment of the invention, an inner sleeve is disposed in contact with the outer surface of the electrode stages and substantially encloses the plurality of channels. An outer sleeve encloses the inner sleeve with a space defined therebetween. The inner sleeve further includes an opening at an end thereof providing an oil communication path between the space between the inner and outer sleeves, and the plurality of channels. An oil source is coupled to one of the inner sleeve and the outer sleeve in order to provide a flow of oil therethrough. The channels may extend axially along the outer surface of the electrodes, or alternatively, helical channels may be provided.

A more complete understanding of the oil-cooled multi-staged depressed collector will be afforded to those skilled in the art, as well as a realization of additional advantages and objects thereof, by a consideration of the following detailed description of the preferred embodiment. Reference will be made to the appended sheets of drawings that will first be described briefly.

BRIEF DESCRIPTION OF THE DRAWINGS

FIG. 2 is a sectional end view of the oil-cooling system and multi-staged depressed collector as taken through the section 2—2 of FIG. 1;

FIG. 3 is an enlarged portion of FIG. 1;

FIG. 4 is a partially cutaway perspective view of an embodiment of the multi-staged depressed collector showing axially-directed cooling channels; and FIG. 5 is a partially cutaway perspective view of an embodiment of the multi-staged depressed collector showing helically-directed cooling channels.

DETAILED DESCRIPTION OF THE PREFERRED EMBODIMENT

Figure 1:
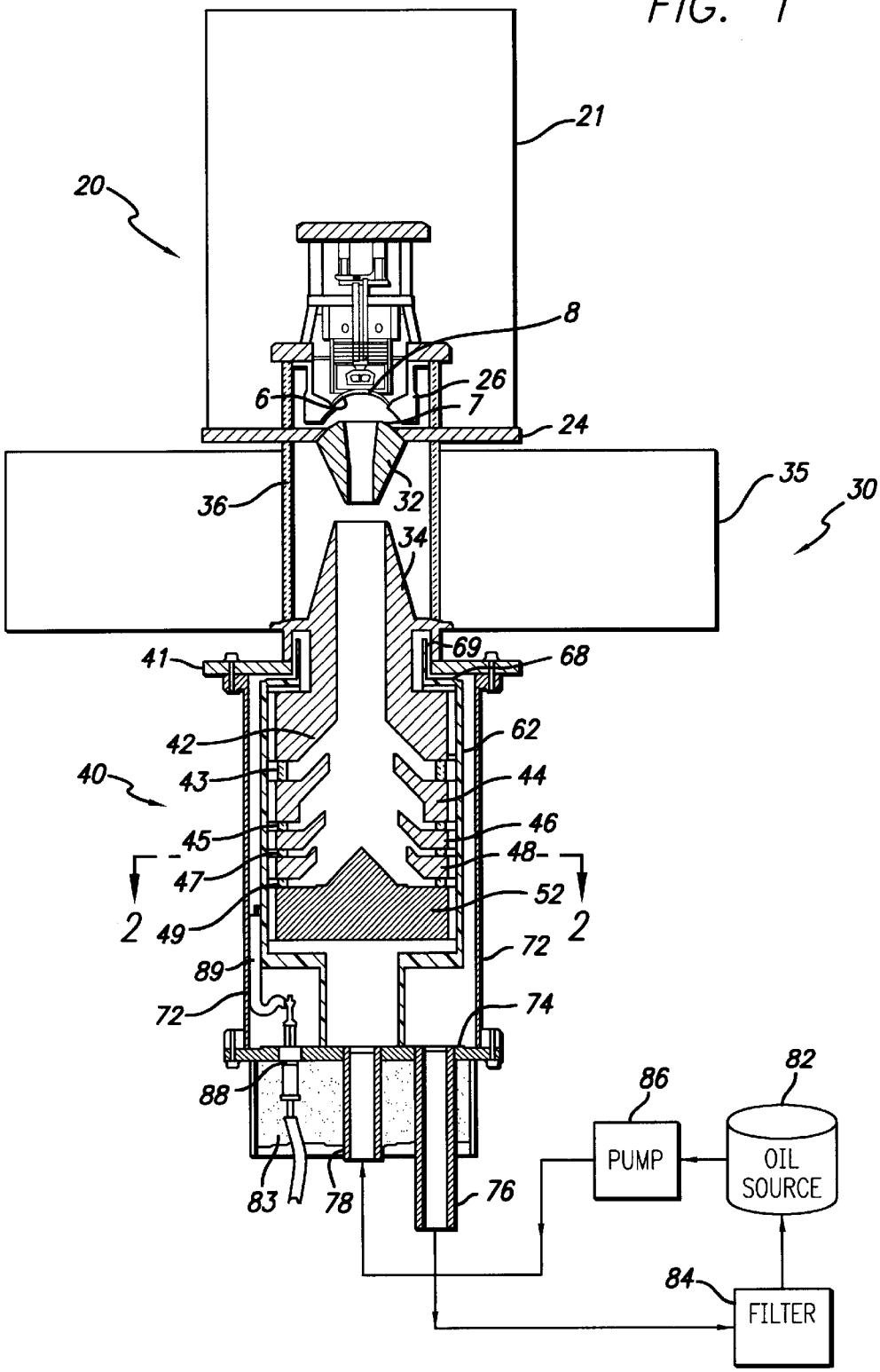
FIG. 1 is a sectional side view of an exemplary inductive output tube having a multi-staged depressed collector with an oil-cooling system in accordance with the present invention.

The present invention satisfies the need for a cooling system for a multi-staged depressed collector that achieves good heat dissipation and high voltage standoff between adjacent collector stages, without increasing the overall size of the collector. In the detailed description that follows, like element numerals are used to describe like elements illustrated in one or more of the figures.

FIG. 1 illustrates an inductive output amplifier in accordance with an embodiment of the invention. The inductive output amplifier includes three major sections, including an electron gun 20, a tube body 30, and a collector 40. The electron gun 20 provides an axially directed electron beam that is density modulated by an RF signal. The electron gun 20 includes a cathode 8 with a closely spaced control grid 6. The cathode 8 is disposed at the end of a cylindrical capsule 23 that includes an internal heater coil 25 coupled to a heater voltage source. The control grid 6 is positioned closely adjacent to the surface of the cathode 8, and is coupled to a bias voltage source to maintain a DC bias voltage relative to the cathode 8. An input cavity 21 receives an RF input signal that is coupled between the control grid 6 and cathode 8 to density modulate the electron beam emitted from the cathode. An example of an input cavity for an inductive output tube is provided by U.S. Pat. No. 6,133,789, the subject matter of which is incorporated in the entirety by reference herein. The grid 6 is physically held in place by a grid support 26. An example of a grid support structure for an inductive output tube is provided by U.S. Pat. No. 5,990, 622, the subject matter of which is incorporated in the entirety by reference herein.

The modulated electron beam passes through the tube body 30, which further comprises a first drift tube portion 32 and a second drift tube portion 34. The first and second drift tube portions 32, 34 each have an axial beam tunnel extending therethrough, and are separated from each other by a gap. An RF transparent shell 36, such as comprised of ceramic materials, encloses the drift tube portions and provides a partial vacuum seal for the device (also shown in FIG. 3). The leading edge of the first drift tube portion 32 is spaced from the grid structure 26, and provides an anode 7 for the electron gun 20. The first drift tube portion 32 is held in an axial position relative to the cathode 8 and grid 6 by an anode terminal plate 24. The anode terminal plate 24 permits electrical connection to the anode 7. An output cavity 35 is coupled to the RF transparent shell 36 to permit RF electromagnetic energy to be extracted from the modulated beam as it traverses the gap. An example of an output cavity for an inductive output tube is provide by U.S. Pat. No. 6,191,651, the subject matter of which is incorporated in the entirety by reference herein.

The collector 40 comprises a generally cylindrical-shaped, enclosed region provided by a series of electrodes. An end of the second drift tube portion 34 provides a first collector electrode 42, which has a surface that tapers outwardly from the axial beam tunnel to define an interior wall of a collector cavity. A polepiece 41 is coupled to the second drift tube portion 34 and provides a structural member for supporting the collector 40. The collector 40 further includes a second electrode 44, a third electrode 46, a fourth electrode 48, and a fifth electrode 52. The second, third, and fourth electrodes 44, 46, 48 each have an annular-shaped main body with an inwardly protruding electron-collecting surface. The fifth electrode 52 serves as a terminus for the collector cavity, and may include an axially centered spike. The shapes of,the electrodes may be selected to define a particular electric field pattern within the collector cavity, as known in the art. Moreover, it should be appreciated that a greater (or lesser) number of collector electrodes could be advantageously utilized, and that the five electrode embodiment described herein is merely exemplary. The electrodes are comprised of an electrically conductive material, such as copper.

As known in the art, each of the collector electrodes has a corresponding voltage applied thereto. In the embodiment shown, the polepiece 41 and second drift tube portion 34 are at a tube body voltage, such as ground, and the first collector electrode 42 is therefore at the same voltage. The other electrodes-have other voltage values applied thereto ranging between ground and the cathode voltage. To prevent arcing between adjacent ones of the electrodes, insulating elements are disposed therebetween. Particularly, insulator 43 is disposed between first and second electrodes 42, 44, insulator 45 is disposed between second and third electrodes 44, 46, insulator 47 is disposed between third and fourth electrodes 46, 48, and insulator 49 is disposed between fourth and fifth electrodes 48, 52. The insulators 43, 45, 47, 49 have an annular shape, and are comprised of an electrically non-conductive material, such as ceramic. During assembly of the collector 40, the collector electrodes 42, 44, 46, 48 and 52 are bonded to the insulators 43, 45, 47, and 49 to provide a vacuum seal within the collector cavity.

As shown in FIGS. 1 and 3, the collector electrodes and insulators are contained within a pair of sleeves that provide a path for a flow of oil coolant. Specifically, an inner sleeve 62 tightly encloses the electrodes and insulators. The insulators 43, 45, 47, and 49 have an outside diameter that is less than that of the electrodes 42, 44, 46, 48 and 52, so that the insulators do not contact the inner sleeve 62. As shown in FIG. 2, axial channels 64 are provided in an outer surface 66 of each of the collector electrodes (e.Q. 46). The axial channels 64 are illustrated as generally rectangular grooves formed in the collector electrode material. The dimensions (i.e., width and depth) of the channels 64 are selected to correspond to the maximum expected heat dissipation of each electrode stage. The channels 64 may have a uniform dimensions with respect to each of the collector electrodes, or the width and/or depth may be individually selected for each electrode. Returning to FIGS. 1 and 3, the inner sleeve 62 has an annular end 68 corresponding to a shoulder defined in the outer surface of the second drift tube portion 34 and a collar 69 coupled to the end 68 (also shown in FIGS. 4 and 5). The collar 69 has an open portion or manifold at an end thereof, permitting a communication path from outside the inner sleeve 62 to the channels 64 provided inside the inner sleeve. The inner sleeve 62 is comprised of an electrically and thermally non-conductive material, such as TEFLON.

An outer sleeve 72 is concentrically spaced from the inner sleeve 62, and is coupled at one end thereof to the polepiece 41. A back channel is defined between the outer sleeve 72 and the inner sleeve 62, as shown in FIG. 2. The outer sleeve is comprised of a rigid material, such as metal. In a preferred embodiment of the invention, the outer sleeve is comprised of cold rolled steel that has the additional benefit of shielding the collector from magnetic fields and preventing leakage of RF radiation from the collector 40. A bottom plate 74 encloses the outer sleeve 72 at an opposite end from the polepiece 41. Seals or gaskets are provided at the joints between the outer sleeve 72, and the polepiece 41 and bottom plate 74, respectively, to prevent leakage of oil. The inner sleeve 62 is reduced in diameter at the bottom end, and also is enclosed by the bottom plate 74. The bottom plate 74 further includes a port 76 that leads into the space defined between the inner and outer sleeves 62, 72, and a port 78 that leads into the space defined within the inner sleeve 62, as shown in FIG. 1.

A cooling system will further include a cooling source 82, filter 84 and pump 86. The cooling source 82 holds a supply of cooling oil, such as a petroleum-based oil, a synthetic oil like polyalphaolefin (PAO) or polyol ester that is commonly used in transformer applications and as motor oil, a fluorochemical used in refrigerant applications, or a commercial coolant product like coolanol. As shown in FIG. 1, oil from the cooling source 82 is coupled under pressure provided by pump 86 to the port 78. The oil then passes through the coolant channels 64 within the inner sleeve 62 past each of the collector electrodes until reaching the manifold at the top of the inner sleeve. The oil then returns through the back channel defined between the inner and outer sleeves 62, 72 to the port 76, whereupon the oil is returned to the cooling source 82. The filter 84 removes any particulate matter from the oil before it is returned to the cooling source 82. The arrows in FIG. 3 illustrates the flow of oil within the coolant channels 64 between the inner sleeve 62 and the collector electrodes, and the return path between the inner and outer sleeves 62, 72. While FIGS. 1 and 3 show a direction of oil flow in which the fifth collector electrode 52 is cooled first, it should be appreciated that the direction of flow can be reversed so that the first collector electrode 42 is cooled first. It is anticipated that the direction of flow be determined based on the operating characteristics of the inductive output tube, such as based on whichever electrode is expected to run the hottest. Alternatively, it would also be possible to dispose a port at an end of the collector 40 adjacent to the polepiece 41, thereby eliminating the oil return path between the inner and outer sleeves 62, 72.

As shown in FIG. 1, in order to provide coupling of a voltage to each of the electrodes, an electrical feedthrough 88 is provided which extends through the bottom plate 74 into the space defined between the inner and outer sleeves 62, 72. A collector lead 89 is coupled between the feedthrough 88 and a corresponding one of the collector electrodes. The lead 89 has an end that is coupled through the inner sleeve 62 to the electrode, such as by a rivet, pin or other like element. While FIG. 1 illustrates only the electrical connection to the fifth collector electrode 52 due to the sectional view, it should be appreciated that the second, third and fourth electrodes will each have similar connections. On the external surface of the bottom plate 74, the high voltage cables that are coupled to the feedthrough are potted with an insulating material 83 such as silicone rubber, or an RF absorbing material such as ECCOSORB. Moreover, to minimize the RF fields between the collector leads, the feedthroughs 88 may be covered with ferrite rings where they enter the space between the inner and outer sleeves 62, 72. It should be appreciated that the oil in that space will provide cooling for the ferrite rings as they will heat up during operation.

FIG. 4 illustrates an embodiment of the invention similar to the embodiment of FIGS. 1–3. In particular, FIG. 4 illustrates a portion of the collector 40 in which the inner sleeve 62 is partially cutaway to reveal the outer surface of the collector electrodes 42, 44, 46, 48, 52 and the insulators 43, 45, 47, and 49. Unlike the preceding embodiment, the outer surface of the insulators is the same as the collector electrodes, so the channels 64 are defined in an axial direction on each of the collector electrodes and insulators, and there is no communication between adjacent channels at the boundaries defined by the insulators as in the previous embodiment. Accordingly, this embodiment makes it possible to flow the cooling oil in different directions through the channels. More specifically, it is possible to flow the oil in one direction (e.g., upward) through a plurality of channels, and in another direction (e.g., downward) through a different plurality of channels. Therefore, it may be possible to eliminate the outer sleeve 72 (see FIGS. 1–3) altogether with this embodiment.

FIG. 5 illustrates another embodiment of the invention. In FIG. 5, a portion of the collector 40 is shown as in FIG. 4 in which the inner sleeve 62 is partially cutaway to reveal the outer surface of the collector electrodes 42, 44, 46, 48, 52 and the insulators 43, 45, 47, and 49, and the outer surface of the insulators is the same as the collector electrodes. Unlike the preceding embodiments, channels 88 are provided in the outer surfaces of the collector electrodes and insulators that follows a generally helical path. The cooling oil may be caused to flow through each of the helical channels in a single direction (similar to FIGS. 1–3), or may flow in different directions through the channels (similar to FIG. 4).

It should be appreciated that the oil-cooled collector of the present invention provides significant advantages over conventional water or air-cooled collectors. Oil has a very high breakdown voltage (i.e., approximately 50 to 58 KV/mm), and therefore resists arcing between the electrode stages. As a result, the entire outer surface of the collector electrodes may be covered with oil, and there are no hoses or other connections between the electrode stages as in water-cooled systems. The oil further protects the metal surfaces of the electrode stages from corroding, and does not cause any electrical corrosion. The oil provides operation at temperatures ranging from −50° C. to 200° C. If filtered, the oil can remain usable for years without changing, thereby providing a very low maintenance system. The oil-cooled collector takes up less space than a water-cooled collector.

Although the cooling surface is somewhat larger, overall space is saved in view of the cooling path through the channels and minimal number of connections. The electrode stages may be constructed using a uniform number and size of channels. Different power dissipation requirements of each stage can be accommodated by selecting the corresponding axial length of the stage. Changes in temperature or oil viscosity can be adjusted for by increasing or decreasing the flow rate. The channels provide laminar flow even at high flow rates. Therefore, the drop in pressure is small and does not increase drastically with the flow rate. Variations in channel spacing due to tolerances are unlikely to produce drastic changes in collector temperatures. The electrode surface temperatures are lower than in an air-cooled collector so there is less stress in the joints between the insulators and the electrodes. Unlike water-cooled collectors, the insulators are cooled as well which also tends to reduce stress. Since the insulators are covered with oil, they are unlikely to collect dust that would cause arcing.

Having thus described a preferred embodiment of an oil-cooled multi-staged depressed collector, it should be apparent to those skilled in the art that certain advantages of the within described system have been achieved. While the multi-staged depressed collector was described above in connection with an inductive output tube, it should be appreciated that the oil-cooling system would work equally well with a multi-staged depressed collector used in a klystron or other type of linear beam device. It should also be appreciated that various modifications, adaptations, and alternative embodiments thereof may be made within the scope and spirit of the present invention. The invention is further defined by the following claims.

What is claimed is:

1. In a linear beam device, a multi-staged depressed collector comprises:

a plurality of electrode stages adapted to have respective electric potentials applied thereto, said plurality of electrode stages being separated from one another by respective electrical insulators, each of said plurality of electrode stages further comprising a respective outer surface;

a plurality of channels disposed along said respective outer surfaces of said plurality of electrode stages;

a first sleeve disposed in contact with said respective outer surfaces of said electrode stages and substantially enclosing said plurality of channels;

a second sleeve enclosing said first sleeve with a space defined therebetween, said first sleeve further having an opening at an end thereof providing an oil communication path between said space and said plurality of channels; and an oil source coupled to said plurality of channels in order to provide a flow of oil therethrough, said plurality of channels providing a direct path for said oil between adjacent ones of said plurality of electrode stages;

wherein, said oil provides cooling of said plurality of electrode stages and electrical insulation between said plurality of electrode stages.

2. The multi-staged depressed collector of claim 1, wherein said electrical insulators have an outside diameter that is less than that of said electrode stages, so that said insulators do not contact said first sleeve.

3. The multi-staged depressed collector of claim 1, further comprising a first port in communication with said plurality of channels within said first sleeve.

4. The multi-staged depressed collector of claim 3, further comprising a second port in communication with said space between said first and second sleeves.

5. The multi-staged depressed collector of claim 1, wherein said second sleeve is comprised of steel.

6. The multi-staged depressed collector of claim 1, wherein said first sleeve is comprised of an electrical and thermally non-conductive material.

7. The multi-staged depressed collector of claim 1, wherein said respective electrical insulators are comprised of a corresponding ceramic material.

8. The multi-staged depressed collector of claim 1, further comprising at least one electrical feedthrough extending into said space between said first and second sleeves, and an electrical conductor connected between said at least one electrical feedthrough and one of said plurality of electrode stages each adapted to have an electric potential applied thereto, said electrical conductor including an end portion that extends entirely through said first sleeve.

9. The multi-staged depressed collector of claim 1, further comprising a lid coupled to and enclosing a common end of said first and second sleeves.

10. The multi-staged depressed collector of claim 1, wherein said linear beam device further comprises an inductive output tube.

11. The multi-staged depressed collector of claim 1, wherein said linear beam device further comprises a klystron.

12. The multi-staged depressed collector of claim 1, wherein said plurality of channels extend in an axial direction along said outer surfaces of said electrode stages.

13. The multi-staged depressed collector of claim 1, wherein said plurality of channels extend in a helical direction along said outer surfaces of said electrode stages.

14. The multi-staged depressed collector of claim 1, wherein said flow of oil through said plurality of channels is in plural directions.

15. In a linear beam device, a multi-staged depressed collector comprises:

a plurality of electrode stages adapted to have respective electric potentials applied thereto, said plurality of electrode stages being separated from one another by respective electrical insulators, each of said plurality of electrode stages further comprising a respective outer surface;

a plurality of channels disposed along said respective outer surfaces of said plurality of electrode stages;

a first sleeve disposed in contact with said respective outer surfaces of said electrode stages and substantially enclosing said plurality of channels; and an oil source coupled to said plurality of channels in order to provide a flow of oil therethrough, wherein said flow of oil through said plurality of channels is in a single direction.

16. In a linear beam device, a multi-staged depressed collector comprises:

a plurality of electrode stages adapted to have respective electric potentials applied thereto, said plurality of electrode stages being separated from one another by respective electrical insulators, each of said plurality of electrode stages further comprising a respective outer surface;

a plurality of channels disposed along said respective outer surfaces of said plurality of electrode stages;

a first sleeve disposed in contact with said respective outer surfaces of said electrode stages and substantially enclosing said plurality of channels; and an oil source coupled to said plurality of channels in order to provide a flow of oil therethrough, wherein said oil further comprises polyalphaolefin.

17. An inductive output tube, comprising:

an electron gun including a cathode, an anode spaced therefrom, and a grid disposed between said cathode and anode, said cathode providing an electron beam that passes through said grid and said anode, said grid being coupled to an input RF signal that density modulates said electron beam;

a drift tube spaced from said electron gun and surrounding said electron beam, said drift tube including a first portion and a second portion, a gap being defined between said first and second portions;

an output cavity coupled with said drift tube, said density modulated beam passing across said gap and inducing an amplified RF signal into said output cavity;

a collector spaced from said drift tube, the electron beam passing into said collector after transit across said gap, said collector having a plurality of electrode stages each adapted to have a respective electric potential applied thereto, said plurality of electrode stages being separated from one another by respective electrical insulators, each of said plurality of electrode stages further comprising a respective outer surface, a plurality of channels disposed along said respective outer surfaces of said plurality of electrode stages;

a first sleeve disposed in contact with said respective outer surfaces of said electrode stages and substantially enclosing said plurality of channels;

a second sleeve enclosing said first sleeve with a space defined therebetween, said first sleeve further having an opening at an end thereof providing an oil communication path between said space and said plurality of channels; and an oil source coupled to an end of said plurality of channels in order to provide a flow of oil therethrough, said plurality of channels providing a direct path for said oil between adjacent ones of said plurality of electrode stages;

wherein, said oil provides cooling of said plurality of electrode stages and electrical insulation between said plurality of electrode stages.

18. The multi-staged depressed collector of claim 17, wherein said electrical insulators have an outside diameter that is less than that of said electrode stages, so that said insulators do not contact said first sleeve.

19. The inductive output tube of claim 17, further comprising a first port in communication with said plurality of channels within said first sleeve.

20. The inductive output tube of claim 19, further comprising a second port in communication with said space between said first and second sleeves.

21. The inductive output tube of claim 17, wherein said second sleeve is comprised of steel.

22. The inductive output tube of claim 17, wherein said first sleeve is comprised of an electrical and thermally non-conductive material.

23. The inductive output tube of claim 17, wherein said respective electrical insulators are comprised of a corresponding ceramic material.

24. The inductive output tube of claim 17, further comprising at least one electrical feedthrough extending into said space between said first and second sleeves, and an electrical conductor connected between said at least one electrical feedthrough and one of said plurality of electrode stages each adapted to have an electric potential applied thereto, said electrical conductor including an end portion that extends entirely through said first sleeve.

25. The inductive output tube of claim 17, further comprising a lid coupled to and enclosing a common end of said first and second sleeves.

26. The inductive output tube of claim 17, wherein said plurality of channels extend in an axial direction along said outer surfaces of said electrode stages.

27. The inductive output tube of claim 17, wherein said plurality of channels extend in a helical direction along said outer surfaces of said electrode stages.

28. The inductive output tube of claim 17, wherein said flow of oil through said plurality of channels is in plural directions.

29. An inductive output tube, comprising:

an electron gun including a cathode, an anode spaced therefrom, and a grid disposed between said cathode and anode, said cathode providing an electron beam that passes through said grid and said anode, said grid being coupled to an input RF signal that density modulates said electron beam;

a drift tube spaced from said electron gun and surrounding said electron beam, said drift tube including a first portion and a second portion, a gap being defined between said first and second portions;

an output cavity coupled with said drift tube, said density modulated beam passing across said gap and inducing an amplified RF signal into said output cavity;

a collector spaced from said drift tube, the electron beam passing into said collector after transit across said gap, said collector having a plurality of electrode stages each adapted to have a respective electric potential applied thereto, said plurality of electrode stages being separated from one another by respective electrical insulators, each of said plurality of electrode stages further comprising a respective outer surface, a plurality of channels disposed along said respective outer surfaces of said plurality of electrode stages;

a first sleeve disposed in contact with said respective outer surfaces of said electrode stages and substantially enclosing said plurality of channels; and an oil source coupled to an end of said plurality of channels in order to provide a flow of oil therethrough, wherein said flow of oil through said plurality of channels is in a single direction.

30. An inductive output tube, comprising:

an electron gun including a cathode, an anode spaced therefrom, and a grid disposed between said cathode and anode, said cathode providing an electron beam that passes through said grid and said anode, said grid being coupled to an input RF signal that density modulates said electron beam;

a drift tube spaced from said electron gun and surrounding said electron beam, said drift tube including a first portion and a second portion, a gap being defined between said first and second portions;

an output cavity coupled with said drift tube, said density modulated beam passing across said gap and inducing an amplified RF signal into said output cavity;

a collector spaced from said drift tube, the electron beam passing into said collector after transit across said gap, said collector having a plurality of electrode stages each adapted to have a respective electric potential applied thereto, said plurality of electrode stages being separated from one another by respective electrical insulators, each of said plurality of electrode stages further comprising a respective outer surface, a plurality of channels disposed along said respective outer surfaces of said plurality of electrode stages;

a first sleeve disposed in contact with said respective outer surfaces of said electrode stages and substantially enclosing said plurality of channels; and an oil source coupled to an end of said plurality of channels in order to provide a flow of oil therethrough, wherein said oil further comprises polyalphaolefin.

* * * * *